US006799646B1

(12) United States Patent
Daigle et al.

(10) Patent No.: US 6,799,646 B1
(45) Date of Patent: Oct. 5, 2004

(54) ADJUSTABLE DEFLECTING SUB

(75) Inventors: Chad M. Daigle, Lafayette, LA (US); Toby S. Baudoin, Lafayette, LA (US); Thomas E. Falgout, Sr., Lafayette, LA (US)

(73) Assignee: Tomahawk Downhole, LLC, Lafayette, LA (US)

( * ) Notice: Subject to any disclaimer, the term of this patent is extended or adjusted under 35 U.S.C. 154(b) by 0 days.

(21) Appl. No.: 10/234,582

(22) Filed: Sep. 3, 2002

(51) Int. Cl.[7] ..... E21B 7/08
(52) U.S. Cl. ..... 175/74; 175/256
(58) Field of Search ..... 175/73, 74, 75, 175/256, 320

(56) References Cited

U.S. PATENT DOCUMENTS 4,813,497 A 3/1989 Wenzel
5,101,915 A 4/1992 Witte
5,479,995 A 1/1996 Falgout, Sr.
6,516,901 B1 * 2/2003 Falgout, Sr. ..... 175/74
6,554,083 B1 * 4/2003 Kerstetter ..... 175/61

* cited by examiner

*Primary Examiner*—William Neuder
(74) *Attorney, Agent, or Firm*—John D. Jeter

(57) ABSTRACT

As a serial element of a drill string, the drill string is adjustably bent by rotating one end of the sub relative to the other end. The opposite ends rotate about a tilted center line such that in one rotational position the sub is straight. One half turn of one end relative to the other bends the sub to the maximum angle. Between straight and maximum bend, any angle can be achieved by control of the amount of the relative rotation between the opposite ends of the sub.

6 Claims, 2 Drawing Sheets

ADJUSTABLE DEFLECTING SUB

This invention pertains to a serial element of a drill string usable for adjustably deflecting the centerline of the associated drill string. The sub is designed to be adjustable by operating personnel on the drilling site.

BACKGROUND OF THE INVENTION

The majority of drilling activities, in the petroleum industry, experience the need to either maintain a vertical well bore or to deflect the progressing well bore from vertical to a predetermined direction.

Directional drilling normally involves down hole instruments to indicate the direction being followed by the drill bead. When errors in direction are detected steps have to be taken to correct the progressing well bore direction. Direction includes deflection from vertical and the azimuth relative to earth. Correction usually involves lateral influence on the drill head. Lateral influence can be applied by several processes but bending the drill string some distance above the drill head seems, at present, to be most reliable. Bending, or deflecting, the drill string has been done by apparatus down hole and controlled by down-link commands from the surface. Such apparatus tends to be complex and not entirely reliable. Reliability is decreased by the apparatus presence down hole, in the hostile environment, and remaining ready to act after hours of drilling activity. Rigidity and durability is demanded of the drill string, near the drill head, and that leaves little radial room in the drill string bore for apparatus. The bore of the drill string has to conduct drilling fluid as well as provide space for apparatus. Designers of down-hole deflection controls have little space in which to fit apparatus required to exert a powerful influence upon drill strings conducting many tons of axial force upon a drill head. There is a need for deflecting apparatus that can be adjusted for deflecting the drill string yet provide a drill string serial element that is rigid and devoid of moving parts while down hole. If the apparatus cannot be adjusted while down hole, it should be adjustable at the rig site by simple processes.

SUMMARY OF THE INVENTION

It is an object of the invention to provide an adjusting sub that can be adjusted by simple rotation of opposite ends of the housing, each end relative to the other.

It is another object of the invention to provide an adjusting sub that can be tightened together for use by applying rig tongs to the sub.

It is yet another object of the invention to provide and adjusting sub that will not cause the tightening torque to derange the adjusted setting.

To achieve the objectives, the novel adjustably bendable sub is to be used as a serial element of a drill string in use. The housing includes two cylindrical bodies joined by a threaded box and pin connection that is tilted relative to the housing general centerline, when the sub is in a straight configuration, an amount one-half the maximum amount of deflection inherent in the design. When the sub is deflected the two bodies have independent center lines, or axes. When one body is rotated relative to the other, one body centerline moves to describe a cone with one line on the cone lying along the center line of the other. That one line is needed to accomplish the straight configuration. The amount of bend is a function of the amount one body is rotated relative to the other, all useful bend angles being accomplishable in one half turn of one body relative to the other, starting from the straight configuration.

Tool joint connections and a bore through the sub provide means to install the sub as a serial element in the drill string for drilling, with the usual mud flow down the string bore.

To secure the sub in the selected configuration an indicator ring is rotationally secured, and axially movable on the outer periphery of one body, preferably by keys or splines. On the same body a sleeve is threadedly secured for axial movement along the threads by tongs usable on the sleeve outer surface, which is about the same outer diameter as the sub. The sleeve on one body axially advances to secure the indicator ring against the face of the other body.

The sub can be used with either end up, but in the preferred orientation the upper body has a tilted threaded box which receives the similarly tilted threaded pin end of the lower body. When the lower body is rotated in the tilted threaded connection relative to the upper body the center line of the lower body describes the cone relative to the center line of the upper body. The centerline of each body is also the centerline of the connected drill string element. When the sub is bent, the related drill string is bent.

The upper body has a lower plane face that is perpendicular to the center line of the threads in the tilted box and pin connection. The sleeve threadedly secured on the lower body has an upper plane face that is perpendicular to the center line of the lower body. The opposed faces then are planes that have an angular relationship equal to the amount of tilt of the box and pin thread axes. To provide a rigid structure of the combined parts of the sub, the indicator ring is captured between the upper body and the sleeve. The ring has opposite plane faces that describe planes with an angular relationship equal to the angle of tilt of the box and pin connection. The indicator ring, being keyed or splined to the lower body, maintains opposed face planes that solidly contact the upper body and the sleeve. When the sleeve is torqued up to capture the indicator ring, the assembly is about as rigid as the related drill string when set at any adjusted angle.

These and other objects, advantages, and features of this invention will be apparent to those skilled in the art from a consideration of this specification, including the attached claims and appended drawings

DETAILED DESCRIPTION OF DRAWINGS

Figure 1:
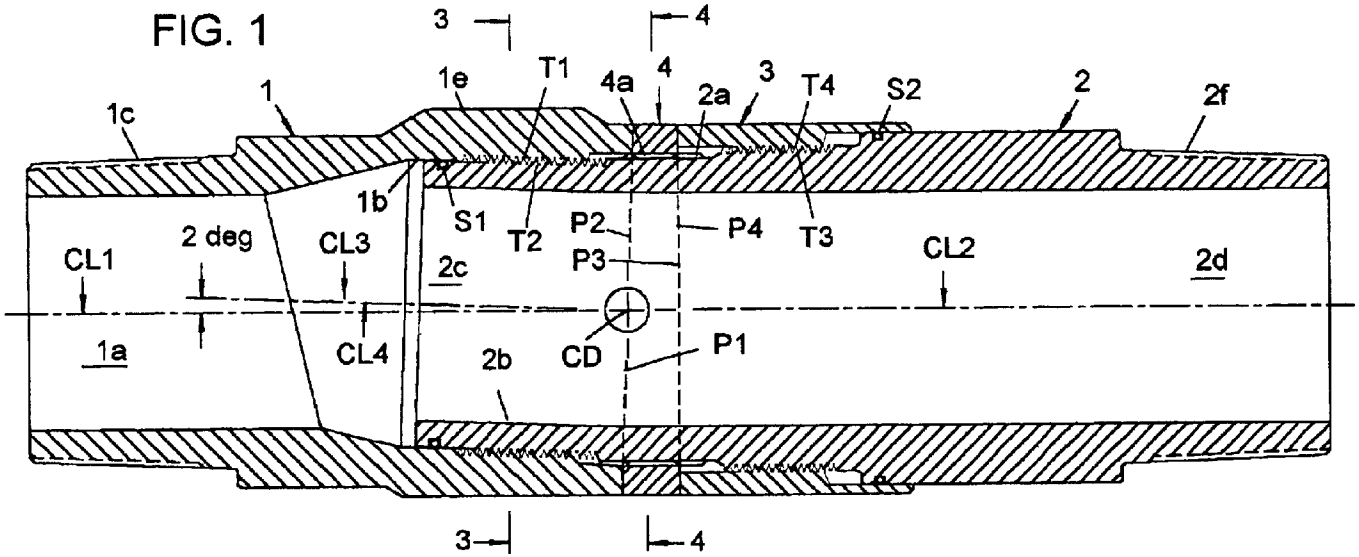
FIG. 1 is a side view, in cutaway of the sub of the preferred embodiment in the straight configuration.

In the drawings like features have like captions. The drawings are formal but some features common to construction choices but not bearing upon points of novelty are omitted in the interest of clarity. Such omitted features may include weld lines, seal back-up rings, and the like.

The drawings describe components and the assembly that represents suitable and preferred configurations of components capable of achieving the objectives of the invention.

FIG. 1 shows the straight configuration of the sub adjusted and torqued together for use in a drill string. The left end is preferably the top end with tool joint pin 1*c* for fluid tight connection to an upwardly continuing part of a drill string component. Tool joint pin 2*f*, for fluid tight attachment to a component of a downwardly continuing drill string part, terminates the housing comprising first body part 1, second body part 2, security sleeve 3 and indicator ring 4. The fluid conducting bores are 1*a*, 2*c*, and 2*d* and conduct fluid moving along the drill string bore (not shown) in normal drilling.

First body 1 has a tilted bore 1*b*, shown with a 2 degree tilt, with center line CL3, relative to the center line CL1 of first body 1. Center line CL2 of body part 2 is the axis of tool joint pin 2*f*, indicator ring 4 and security sleeve 3. That relationship is retained during all adjustments. The threaded pin end 2*b* of body part 2 is tilted, with center line CL4, which is coincident with CL3 during all adjustments. In the straight configuration shown, CL1 and CL2 are coincident. The box 1*b* and pin 2*b* are joined by mating threads T1 and T2 respectively. One-half turn of threads T2 in T1 provides a full range of adjustment of the angle between CL1 and CL2.

Sleeve 3 is mounted on body part 2 by threads T4 and T3 respectively which lie along center line CL2 and it can move axially thereon. Sleeve 3 has plane end P3 which is always perpendicular to CL2. Ring 4 and sleeve 3 abut at ring end plane P4. Both P3 and P4 are transverse CL2.

Indicator ring 4 has opposite plane faces P2 and P4. The angular relationship of the two planes is the same as the tilt angle of CL4 relative to CL1.

Body part 2 has an outer surface 2*a*, non-circular and preferably splined, to mate with a similarly shaped bore 4*a* in indicator ring 4. Ring 4 can move axially along CL2. The lower face of body part 1 is plane surface P1, perpendicular to CL3 and CL4, which describes also the upper abutting face P2 of the indicator ring.

Figure 2:
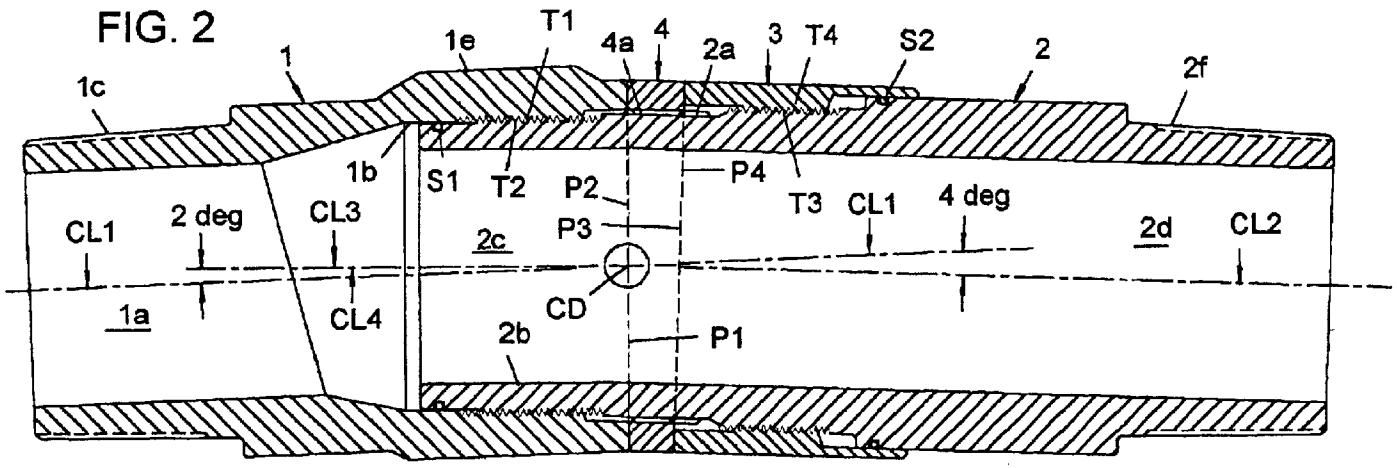
FIG. 2 is identical to FIG. 1 with the sub in the deflected configuration.
Figure 5:
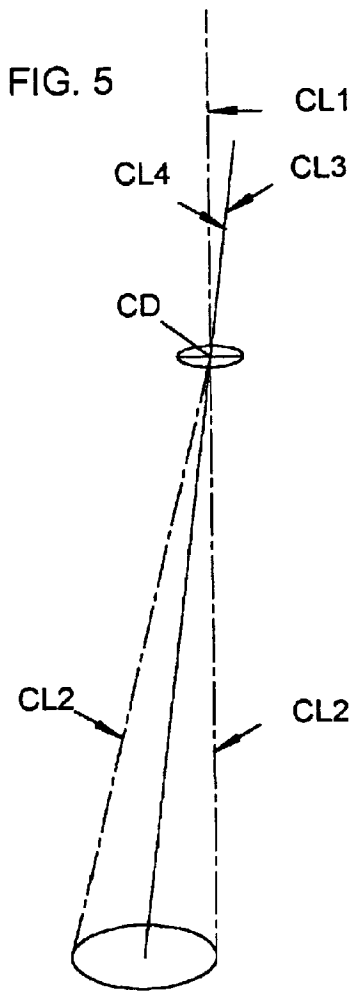
FIG. 5 is a display of center lines of the sub principal components and their relationships when one end of the sub is rotated relative to the other.

To adjust the angle between CL1 and CL2, sleeve 3 is loosened by rotation relative to body part 2 to free ring 4 to rotate relative to body part 1. That frees body part 2 to rotate relative to body part 1. When body part 2 rotates relative to body part 1 the angle between CL1 and CL2 changes according to a function of the amount of relative rotation during one-half turn at which point the angular difference is twice the amount of tilt of angle (2 deg.) between CL1 and CL3, or 4 degrees as shown. That is the relationship shown in FIG. 2 . The center line relationships are shown in FIG. 5. The inherent maximum design angle of a sub is defined by the task at hand and 4 degrees was chosen for descriptive purposes.

Seals S1 and S2 make the overall housing fluid tight and keep mud out of the threads. The center lines cross at point CD. At any angular adjustment the overall housing can be made rigid by tightening sleeve 3 against ring 4 to prevent rotation between opposite ends of the housing and stiffen the assembly. Projection 1*e* bears on a bore hole wall when the sub is bent and the drill string is column loaded for drilling.

Tightening the assembly after adjustment requires considerable torque and that has invited slippage of the adjustment in past designs. With the present concept torque is applied between sleeve 3 and body part 2. Sleeve 3 abuts the indicator ring 4 and tends to turn the ring but the ring and body part 2 are splined together to prevent deranging the adjustment.

Figure 3:
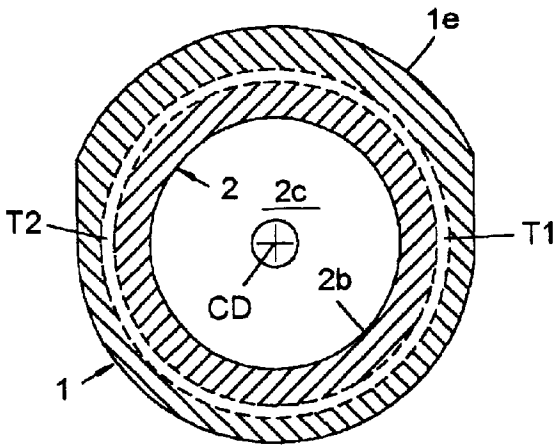
FIG. 3 is a sectional view taken along line 3—3 of FIG. 1.

In FIG. 3, taken along line 3—3 of FIG. 1, note that projection 1*e* wraps about 120 degrees of the periphery of body part 1. Other captions have the same identity as those in FIGS. 1 and 2.

Figure 4:
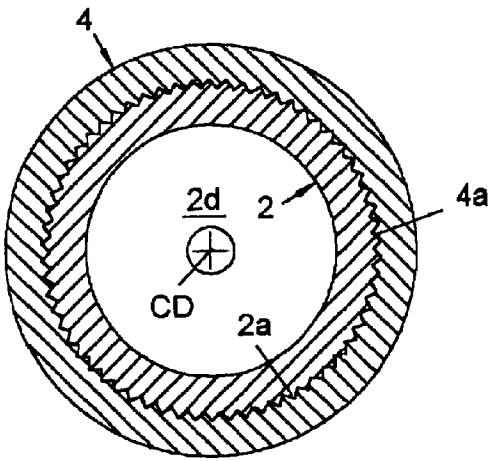
FIG. 4 is a sectional view taken along line 4—4 of FIG. 1.

In FIG. 4, splines 2*a* and 4*a* can be replaced by a key and keyway to achieve the non-rotational relationship purpose of pairing non-circular machine members. Such pairing is well withing the understanding of those skilled in the art. Other captions are identified for FIGS. 1 and 2.

FIG. 5 shows the relationships of the center lines of the various parts of the preferred embodiment. CL3 and CL4 are always coincident. Note that in one position CL1 and CL2 are coincident and comprise a general centerline, or axis, of the overall housing in the straight configuration.

Center lines, as defined herein are axes as well.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the adjusting sub of this invention without departing from the scope thereof, it is to be understood that all matter herein set forth or shown in the accompanying drawings is to be interpreted as illustrative and not in a limiting sense.

What is claimed is:

1. An adjustable drill string deflecting sub, to adjust between a straight configuration and a selected maximum angle, comprising:

a) a generally cylindrical elongated housing comprised of a first body part, with a first center line, and a second body part, with a second center line, said first and second center lines being co-incident when the housing is in the straight configuration, the two bodies being coupled together by axially extending mating threads that lie along a third center line that is tilted a selected angle relative to said second center line, the second body part having an external surface with non-circular external surface extending a distance along said second center line, external threads continuing from said non-circular external surface a selected distance along said second center line;

b) an indicator ring distributed around said non-circular external surface to axially move along that periphery with a bore to engage said non-circular external surface with a non-rotational relationship;

c) a security sleeve with internal threads to engage the external threads and abut the indicator ring to rotationally secure the indicator ring between said first and said second body parts;

d) means at opposite ends of the housing for attachment to continuing drill string elements, and an opening to conduct drilling fluid between said continuing drill string elements; and e) said first and said second bodies connected directly by mating threads.

2. The adjustable drill string deflecting sub according to claim 1 wherein said first body part and said second body part are dimensioned to allow rotation of one body part relative to the other at least one half turn about said third center line to deflect one end of the housing relative to the other.

3. The adjustable drill string deflecting sub according to claim 1 wherein said indicator ring has plane ends that define plane surfaces with angular relationships corresponding to said selected angle.

4. An adjustable drill string deflecting sub, comprising:

a) a first, generally cylindrical body part having means at a first end, for attachment to a continuing drill string element, having a first center line, and a generally central opening, a threaded receiving box with a third center line that is deflected from the first center line at a first prescribed angle and opening at a second end, terminating with a first plane face that is transverse the third center line;

b) a second, generally cylindrical, body part having a generally cental bore extending therethrough, means for attachment to a continuing drill string element and containing a second center line on a first end, first external threads about mid length with an center line generally coincident with said second center line, a second end with second external threads on a fourth center line that is deflected at a second prescribed angle relative to said second center line, said second external threads to mate with and engage threads in said threaded receiving box, and a length between said first and second threads having non-circular external contour generally distributed peripherally about said second center line;

c) an indicator ring having a bore contoured to slide axially, non-rotationally, on said non-circular contour with an external diameter approximating the outer diameter of said first generally cylindrical body, with a second plane end perpendicular to the second center line and a third plane end perpendicular to the third center line;

d) a security sleeve with a threaded bore to engage the first external threads, having a fourth plane end arranged to abut the third plane end of the indicator ring;

e) said third and said fourth center lines being coincident and said first and said second prescribed angles being about equal.

5. The adjustable drill string deflecting sub according to claim 4 wherein said first generally cylindrical body and said second generally cylindrical body are arranged to permit rotation therebetween about at least one-half turn.

6. The adjustable drill string deflecting sub according to claim 4 wherein said security sleeve is arranged to be rotated, relative to said second generally cylindrical body part, such that it secures said second plane end solidly against said first plane end.

* * * * *